US008033060B2

(12) United States Patent
Parker et al.

(10) Patent No.: US 8,033,060 B2
(45) Date of Patent: Oct. 11, 2011

(54) PERSONAL OBSERVATORY STRUCTURE HAVING PIVOTALLY CONNECTED DOME SEGMENTS

(75) Inventors: Wayne J. Parker, Staffa (CA); Farhat Hanna, Longueuil (CA)

(73) Assignee: 1537636 Ontario Inc., Staffa, Ontario (CA)

( * ) Notice: Subject to any disclaimer, the term of this patent is extended or adjusted under 35 U.S.C. 154(b) by 1252 days.

(21) Appl. No.: 11/453,847

(22) Filed: Jun. 16, 2006

(65) Prior Publication Data

US 2007/0289227 A1 Dec. 20, 2007

(51) Int. Cl.
*E04B 7/16* (2006.01)
*B65D 43/16* (2006.01)

(52) U.S. Cl. ..... 52/65; 52/66; 220/252

(58) Field of Classification Search ..... 52/66, 64, 52/72, 65, 6, 80.1, 82, 79.4; 49/40, 41, 125, 49/126; 220/252
See application file for complete search history.

(56) References Cited

U.S. PATENT DOCUMENTS

| | | | | | |
|---|---|---|---|---|---|
| 1,091,008 | A | * | 3/1914 | Nagle | 220/252 |
| 2,080,786 | A | * | 5/1937 | Robles | 220/252 |
| 2,428,839 | A | * | 10/1947 | Di Salino | 220/252 |
| 3,118,186 | A | | 1/1964 | Moss | |
| 3,213,571 | A | | 10/1965 | Olson | |
| 3,245,178 | A | | 4/1966 | Clark | |
| 3,370,380 | A | | 2/1968 | Petros | |
| 3,387,356 | A | | 6/1968 | Clark | |
| 3,421,004 | A | | 1/1969 | Cashion | |
| 3,951,294 | A | * | 4/1976 | Wilson | 220/4.31 |
| 4,303,172 | A | * | 12/1981 | Bosland | 220/252 |
| 4,306,390 | A | * | 12/1981 | Brown | 52/67 |
| D275,888 | S | | 10/1984 | Lauer et al. | |
| 4,840,458 | A | | 6/1989 | Cliffton | |
| 4,918,881 | A | | 4/1990 | Cottle et al. | |
| 5,070,659 | A | | 12/1991 | Brisbin et al. | |

(Continued)

FOREIGN PATENT DOCUMENTS

EP 0152715 B1 12/1984

(Continued)

OTHER PUBLICATIONS

PCT International Searching Authority, PCT International Search Report, Sep. 20, 2007, PCT/CA2007/001037.

(Continued)

*Primary Examiner* — Michael Safavi
(74) *Attorney, Agent, or Firm* — Bereskin Parr LLP/S.E.N.C.R.L., s.r.l.

(57) ABSTRACT

A personal observatory structure includes a base having an open top, and a hemispherical dome having a center point. The dome is shaped to be mounted on the base and to selectively enclose the open top. The hemispherical dome includes a first dome segment and a second dome segment pivotally connected to the first dome segment. The second dome segment has an outer radius smaller than the inner radius of the first dome segment. The first dome segment and second dome segment are connected together by pivotal connectors for movement about a pivot axis. One of the domes can be pivoted from a lowered position, in which the dome segments together enclose the open top of the base, to a raised position which exposes the interior and nests one dome segment within the other. The pivot axis may be a horizontal pivot axis that extends through the center point, and the dome segments may be shaped generally in the form of a quarter sphere.

19 Claims, 16 Drawing Sheets

U.S. PATENT DOCUMENTS

| | | | | |
|---|---|---|---|---|
| 5,117,594 | A | 6/1992 | Muramoto et al. | |
| D343,058 | S * | 1/1994 | Allegre | D3/294 |
| 5,448,860 | A | 9/1995 | Menke et al. | |
| 5,625,982 | A | 5/1997 | Foote | |
| 5,881,896 | A * | 3/1999 | Presnell et al. | 220/252 |
| 6,260,309 | B1 | 7/2001 | Cliffton | |
| 6,523,308 | B1 * | 2/2003 | Gillispie | 52/67 |
| 7,346,937 | B1 * | 3/2008 | Pollack | 4/488 |

FOREIGN PATENT DOCUMENTS

| | | |
|---|---|---|
| KR | 2002000078079 | 12/2002 |
| SU | 0937657 | 6/1982 |

OTHER PUBLICATIONS

PCT International Searching Authority, PCT Written Opinion, Sep. 20, 2007, PCT/CA2007/001037.

PCT International Searching Authority, PCT International Search Report, PCT/CA2007/001037 (Published date according to initial publication of PCT Application PCT/CA2007/001037: Dec. 21, 2007) [mailed to Applicant on Sep. 20, 2007].

PCT International Searching Authority, PCT Written Opinion, PCT/CA2007/001037 (Published date: Dec. 16, 2008) [mailed to Applicant on Sep. 20, 2007].

Explora Dome by Polydome. The affordable observatory dome [online], (Published Date: Mar. 2006) [retrieved on Apr. 9, 2006]. Retrieved from the Internet: <URL http://www.explora-dome.com/ >.

Translation of Russian Patent No. 937657. (Publication date of original patent reference: Jun. 23, 1982) [translation obtained on Nov. 21, 2009].

* cited by examiner

PERSONAL OBSERVATORY STRUCTURE HAVING PIVOTALLY CONNECTED DOME SEGMENTS

FIELD OF THE INVENTION

The present invention relates to astronomical observatories, and in particular, to small-scale observatories for amateur astronomers, known as personal observatories.

BACKGROUND OF THE INVENTION

Astronomical observatories have been known and used for many years to house telescopes for celestial observation. Most of these observatories are large-scale structures comprising a base and a hemispherical dome that rotates about the base. The dome of these structures typically includes a shutter system comprising a longitudinal observation slot extending from the top to the bottom of the dome, and a pair of shutter doors that slide laterally to open and close the observation slot. These observatories typically include electric motors and automated control systems that control the movement of the telescope, dome and shutter doors, to enable the telescope to view all sections of the sky from the horizon to the zenith. While conventional large-scale observatories are useful for professional astronomers, they have certain disadvantages. In particular, conventional observatories are complex and costly structures, which are permanently fixed in a given location, and not generally available for use by the public.

There exist small-scale observatory structures for use by amateur astronomers, known as personal observatories. Most of these personal observatories are similar in form to conventional large-scale observatories, in that they comprise rotatable, hemispherical domes with observation slots similar to those of conventional observatories. However, this type of personal observatory typically requires costly control systems to synchronize the movement of the telescope and the dome. Also, since the observation slot is small in size relative to the volume of air inside the observatory, there can be turbulence or a chimney effect distorting the view when warm air leaving from inside observatory into cold air outside produces eddies with differing air density and different indices of refraction for light.

Another type of personal observatory structure comprises a rectangular building having a peaked, roll-off roof that slides laterally along tracks until the interior of the observatory is open to the sky. This type of personal observatory structures eliminates the chimney effect. However, with no rotation capability, the roof will always block a section of the sky. Also, these buildings are generally made of wood, and while they can be produced in kit form, the kits are relatively heavy and expensive to ship, and they require some expertise to erect.

There is accordingly a need in the art for a personal observatory structure that does not suffer from the chimney effect and that provides a very wide and tall angle of view so that the dome need only be rotated rarely. Furthermore there is a need for an inexpensive personal observatory that is conveniently transported and assembled or disassembled.

SUMMARY OF THE INVENTION

The present invention is directed to a personal observatory structure comprising a base having an open top, and a hemispherical dome having a center point, the dome being shaped to be mounted upon the base and to selectively enclose the open top. The dome comprises a first dome segment having a spherical inner surface extending at a first radius from the center point, and a second quarter dome segment having a spherical outer surface extending at a second radius from the center point, the second radius being smaller than the first radius. The first dome segment and the second dome segment are pivotally connected together by pivotal connectors for movement about a pivot axis, so that one of the dome segments can be pivoted about the pivot axis between a lowered position in which the dome segments together enclose the open interior, and a raised position in which one of the dome segments nests within the other.

The horizontal pivot axis is preferably a horizontal pivot axis that extends through the center point. The first and second dome segments are preferably shaped generally in the form of a quarter sphere. The second dome segment is preferably pivotally connected to the first dome segment so that the second dome segment can be pivoted about the pivot axis by a pivot angle of approximately 90 degrees, and nest within the first dome segment. The pivotal connectors preferably comprise a pair of diametrically opposed hinge portions, with each of the hinge portions comprising a hinge pin extending along the pivot axis.

The base preferably comprises a cylindrical wall having an upwardly extending cylindrical top collar portion. The dome is preferably rotatably mounted on the top collar portion for rotation around the top collar portion about a vertical axis of rotation. The first and second dome segments preferably comprise protective skirts extending outwardly from peripheral portions thereof, the skirts being shaped to extend over the top collar portion.

The personal observatory structure preferably includes weather sealing means for providing a weather resistant seal between the outer surface of the second dome segment and the inner surface of the inner surface of the first dome segment. The dome may include a dome locking mechanism for selectively preventing opening of the second dome segment.

The base and the hemispherical dome are preferably made of light-weight, modular panels, which are easily attachable and assembled by non-professionals.

The present invention is also directed to a personal observatory structure comprising a base having an open top and a cylindrical outside wall having a cylindrical top collar extending upwardly therefrom, and a hemispherical dome having a center point, the dome being shaped to be rotatably mounted upon the cylindrical collar portion for rotational movement about a vertical axis extending through the center point. The dome comprises a first generally quarter spherical dome segment having an inner surface extending at a first radius from the center point, and a second generally quarter spherical dome segment having an outer spherical surface extending at a second radius from the center point, the second radius being smaller than the first radius. The second dome segment is pivotally connected to the first dome segment by pivotal connectors for pivotal movement about a horizontal pivot axis extending through the center point, so that the second dome segment can be pivoted about the pivot axis between a lowered position in which the second dome segment and the first dome segment enclose the open top, and a raised positioning which the second dome segment nests within the first dome segment.

BRIEF DESCRIPTION OF THE DRAWINGS

The invention will now be described, by way of example only, with reference to the following drawings, in which.

DETAILED DESCRIPTION OF THE INVENTION

Referring to FIGS. 1-5, illustrated therein is a personal observatory structure 10 made in accordance with a preferred embodiment of the subject invention. The personal observatory structure 10 comprises a base 12 having an open top 13, and a hemispherical dome 14 having a center point C. Hemispherical dome 14 is sized and shaped to be mounted on base 12 and to enclose open top 13.

Figure 1:
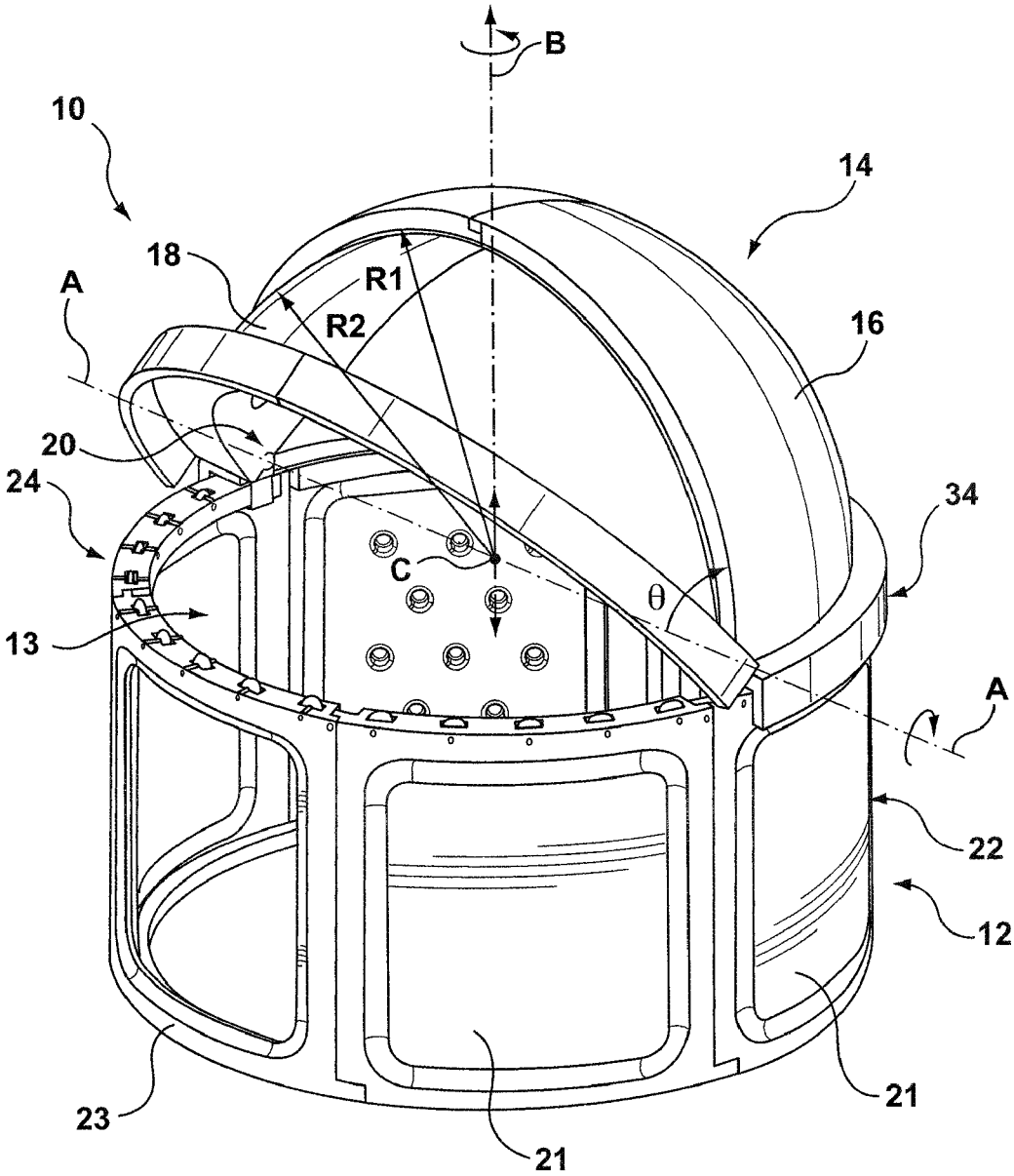
FIG. 1 is a perspective view of a personal observatory structure made in accordance with a preferred embodiment of the invention showing the second dome segment in a partially open position.
Figure 2:
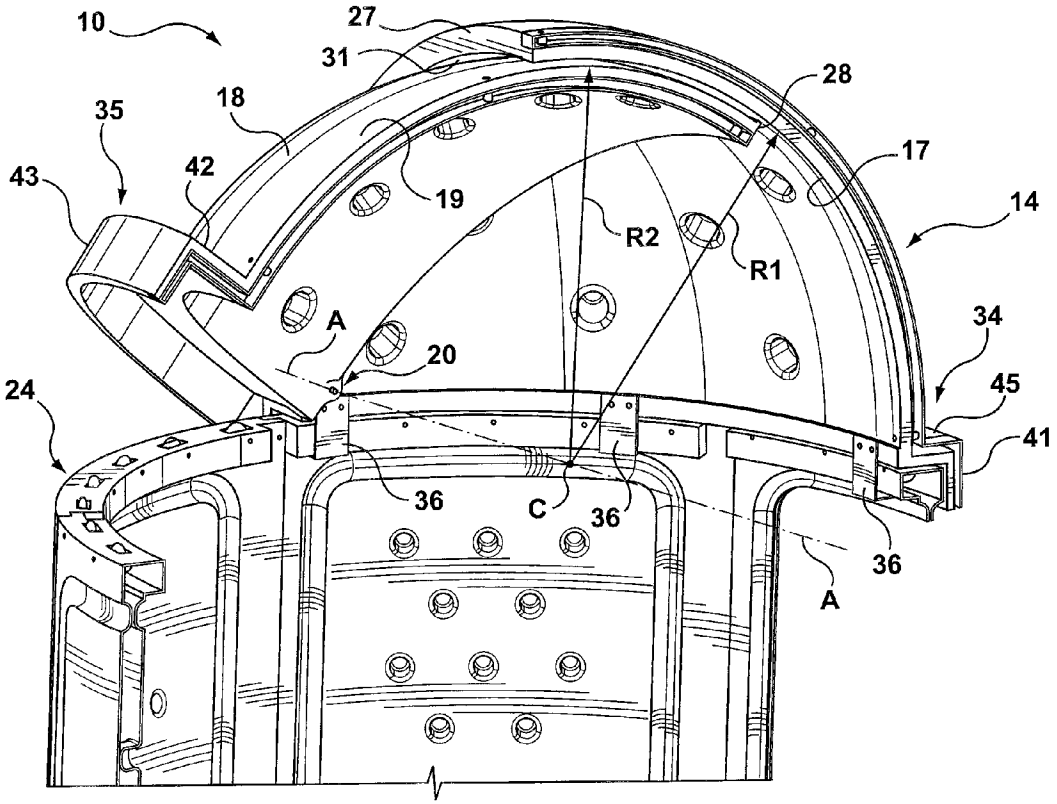
FIG. 2 is an isometric cross sectional view of the subject personal observatory structure showing the first dome segment without any weather stripping and the second dome segment in a partially open position.

Hemispherical dome 14 comprises a first dome segment 16 and a second dome segment 18. As best shown in FIG. 2, first dome segment 16 has a spherical inner surface 17 extending at a radius R1 from center point C, and second dome segment 18 has a spherical outer surface 19 extending at a radius R2 from center point C. Radius R2 is smaller than radius R1, resulting in a gap 31 between first dome segment 16 and second dome segment 18. In the preferred embodiment, inter-dome gap 31 is approximately ¾ inch, but this may vary depending on the materials and techniques used for construction.

Figure 3:
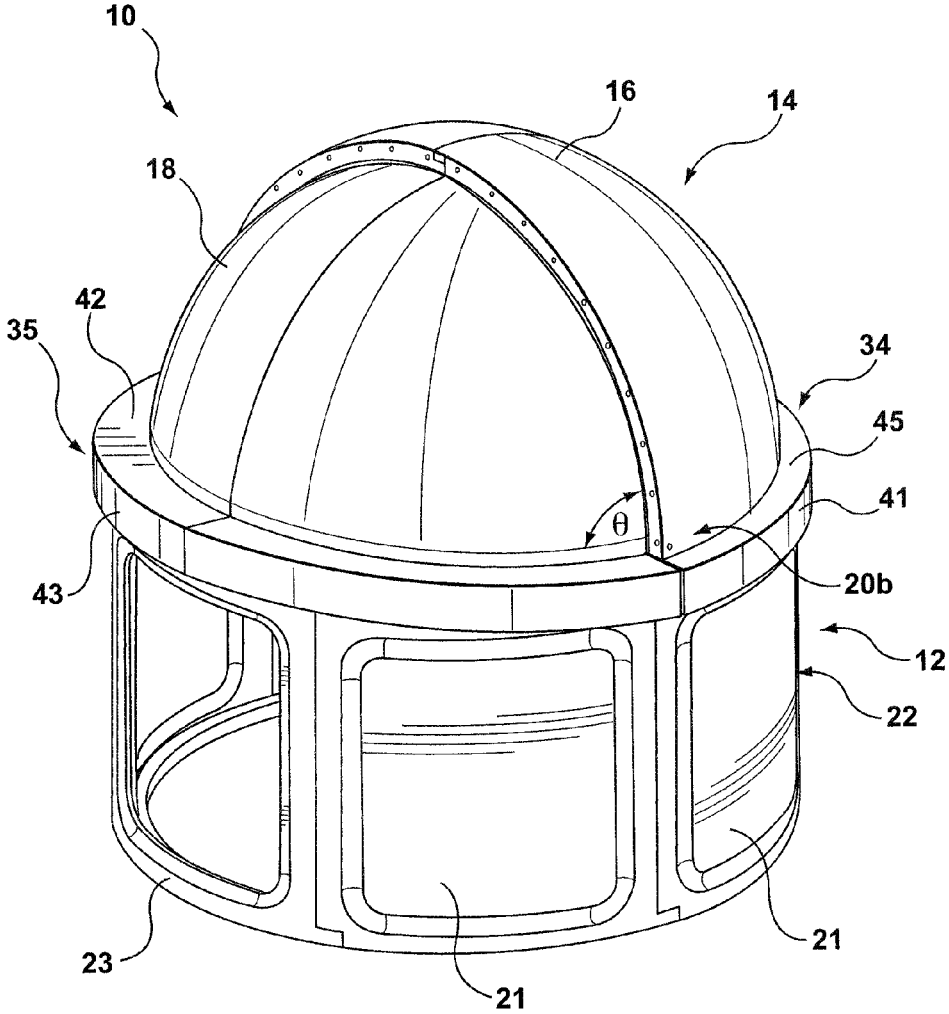
FIG. 3 is a perspective view of the personal observatory structure showing the second dome segment in its lowered position.
Figure 5:
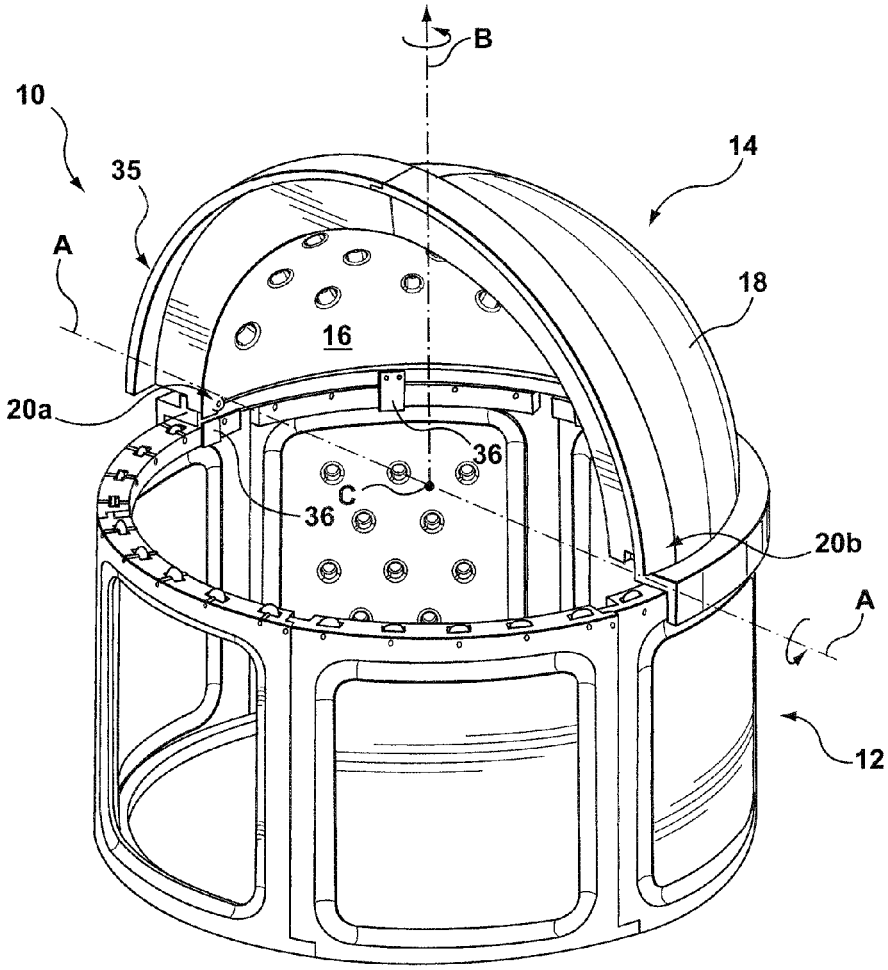
FIG. 5 is a perspective view of the personal observatory structure of the present invention showing the second dome segment in its raised position.

First dome segment 16 and second dome segment 18 are connected together by pivotal connectors 20 for pivotal movement about a pivot axis A so that second dome segment 18 can be pivoted between a lowered position shown in FIG. 3, in which dome segments 16, 18 together enclose open top 13, and a raised position shown in FIG. 5, in which second dome segment 18 nests within first dome segment 16. Pivot axis A is preferably a horizontal pivot axis that extends through the center point C of hemispherical dome 14. Second dome segment 18 can be pivoted about pivot axis A by a pivot angle θ of approximately 90 degrees.

Figure 4:
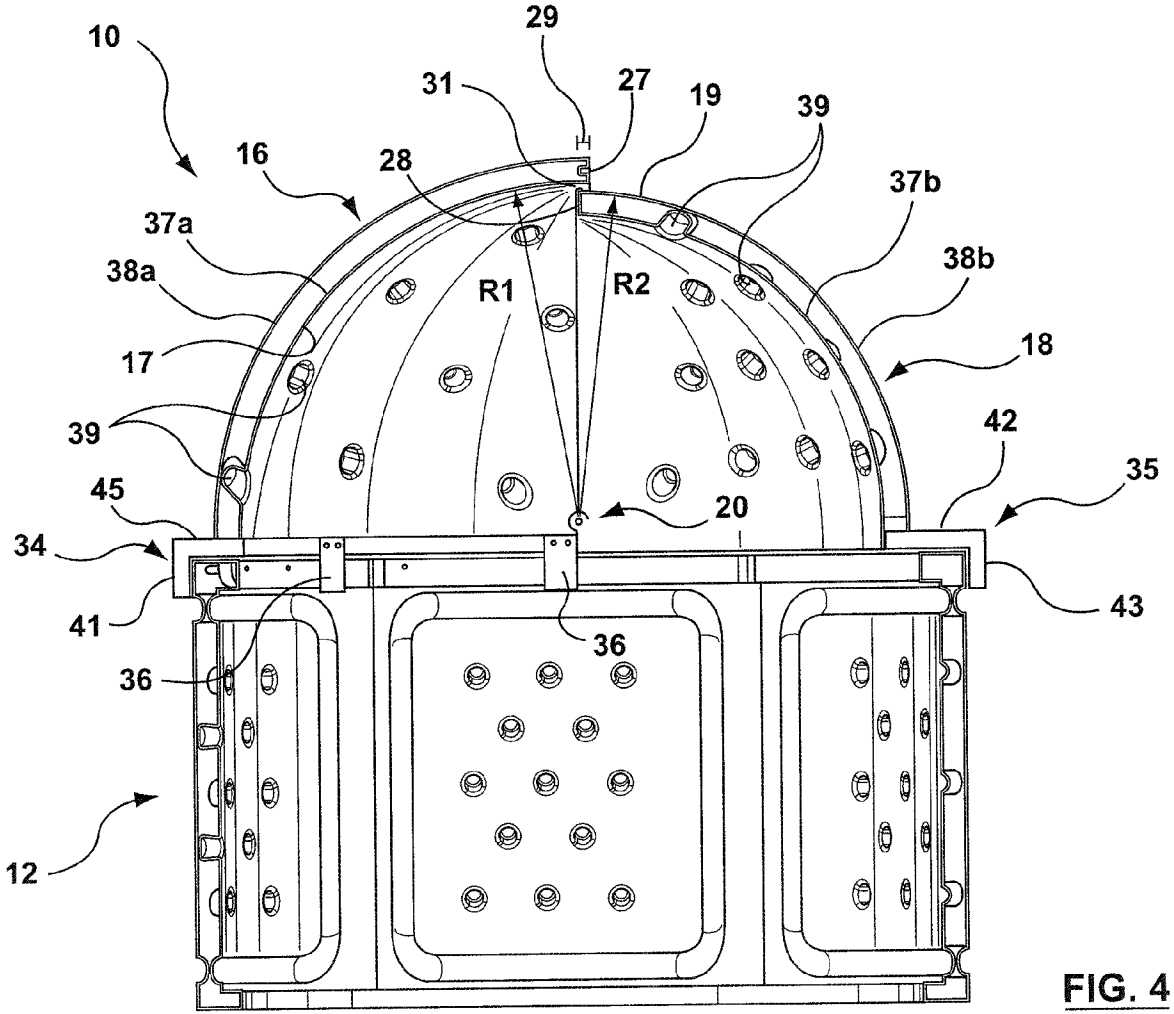
FIG. 4 is a cross sectional view of the personal observatory structure showing the second dome segment in its lowered position.

First dome segment 16 and second dome segment 18 are shaped generally in the form of a quarter sphere, although first dome segment 16 is preferably slightly larger than a quarter sphere so as to overlap a portion of second dome segment 18 when second dome segment 18 is in its lowered position. As best shown in FIG. 4, first dome segment 16 has a generally vertically extending outside end face 27, and second dome segment 18 has an inside end face 28 that extends generally vertically when dome segment 18 is in its lowered position. First dome segment 16 includes an overlap portion 29 that overlaps and covers inside end face 28 of second dome section 18 when second dome segment 18 is in its lowered position.

Referring again to FIG. 1, base 12 is preferably a modular base comprising a plurality of curved wall panels 21, including door panel 23, which interlock together to form a cylindrical outside wall 22 having a cylindrical top collar portion 24 extending upwardly therefrom. Hemispherical dome 14 is shaped to be mounted on top collar portion 24 of outside wall 22. Dome 14 is preferably rotatably mounted on top collar portion 24 for rotation around top collar portion 24 about a vertical axis of rotation B.

As best shown in FIG. 3, first dome segment 16 includes a first protective skirt 34 extending outwardly from a peripheral portion thereof, and second dome segment 18 includes a second protective skirt 35 extending outwardly from a peripheral portion thereof. First and second protective skirts 34, 35 are shaped to extend over top collar portion 24 of outside wall 22 in order to constrain rotary movement of hemispherical dome 14 around top collar portion 24, and to protect the interior of structure 10 from the elements. First protective skirt 34 comprises a horizontal ledge portion 45 and a vertical side portion 41, and second protective skirt 35 comprises a ledge portion 42 and a side portion 43. Protective skirts 34 and 35 are shaped so that the top of ledge portion 42 is flush with top ledge portion 41 when second dome segment 18 is in its lowered position. Ledge portion 42 of second protective skirt 35 also serves as a stopper that prevents second dome segment 18 from pivoting more than dome opening angle θ.

As shown in FIG. 4, dome segments 16, 18 preferably comprise double wall quarter sphere panels having inner walls 37*a*, 37*b* and outer walls 38*a*, 38*b*, made of light weight thermoplastic or high density plastic. Inner walls 37*a*, 37*b* and outer walls 38*a*, 38*b* are shaped by roto-molding to a thickness on the order of two to three millimeters with approximately seven centimeters between the inner walls 37*a*, 37*b* and outer walls 38*a*, 38*b*. Because the plastic is thin to reduce weight and cost, inner walls 37*a*, 37*b* include circular reinforcing indentations 39 known as kiss-offs, shaped to touch the inner surface of outer walls 38*a*, 38*b* in order to stiffen the walls. These reinforcing indentations 39 may alternatively be shaped in the form of a star or other decorative pattern. The plastic used to make dome segments 16, 18 may also be impregnated with a photo luminescent material to provide a low level of light for the interior of structure 10 while not interfering with the user's night vision.

As shown in FIGS. 2, 4 and 5, observatory structure 10 preferably includes a plurality of retaining brackets 36 that retain first dome segment 16 to top collar portion 24 of outside wall 22. Retaining brackets 36 are shaped to prevent dome 14 from detaching from base 12, and to confine the movement of hemispherical dome 14 to rotation around the perimeter of top collar portion 24, especially when second dome segment 18 is opened and second protective skirt 35 is no longer in contact with the outer edge of top collar portion 24 and thus no longer serving to guide the movement of dome 14. In the preferred embodiment, there are six retaining brackets 36 spaced around the perimeter of first dome segment 16.

As shown in FIG. 5, pivotal connectors 20 preferably comprise a pair of hinge portions 20*a*, 20*b*, located on diametrically opposing sides of dome segments 16, 18. Hinge portions 20*a*, 20*b* enable second dome segment 18 to pivot freely about horizontal pivot axis A, up to dome opening angle θ and to nest within first dome segment 16.

Figure 6:
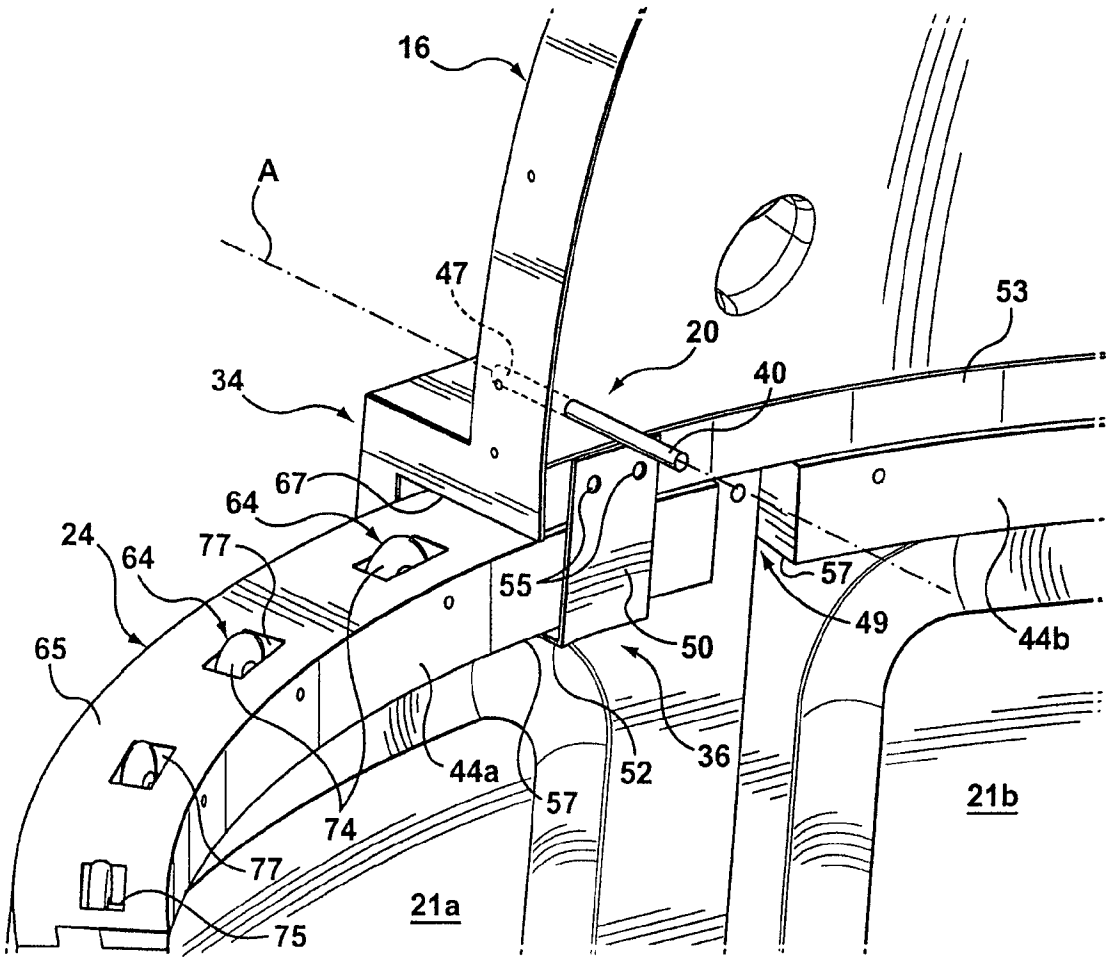
FIG. 6 is a detailed perspective view of a portion of the subject observatory structure, showing one of the pivotal connectors, without the second dome segment attached.
Figure 7:
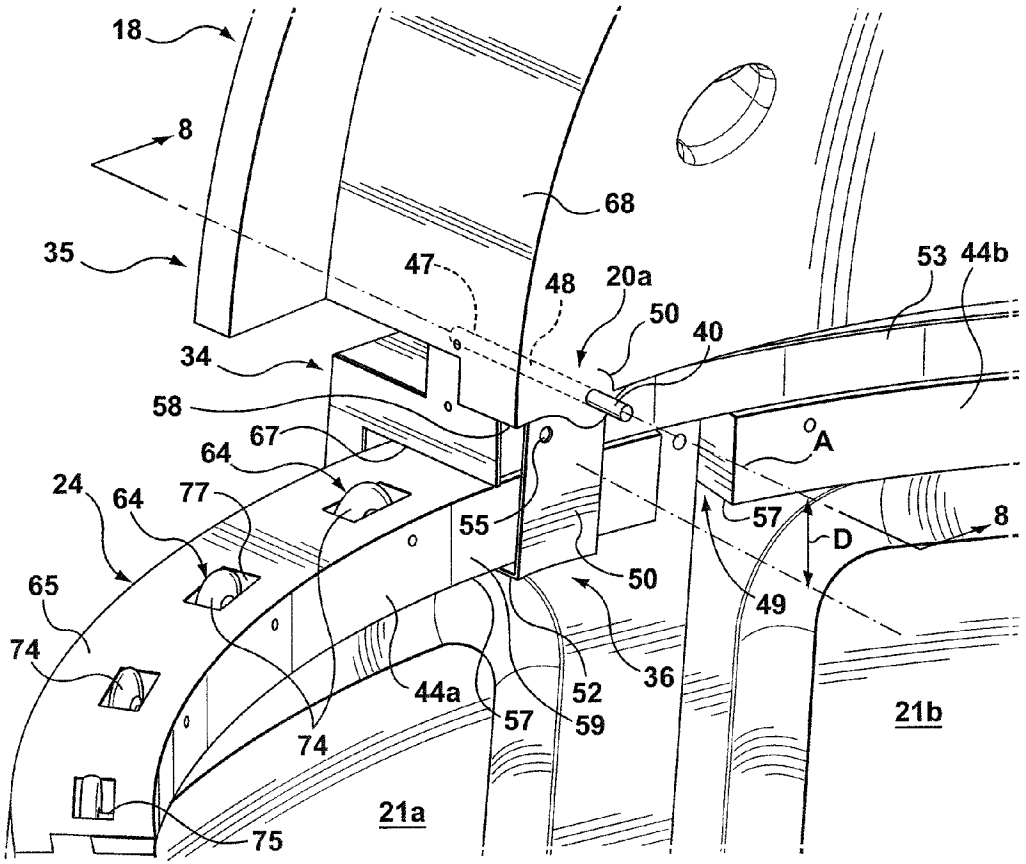
FIG. 7 is a detailed perspective view of a portion of the subject observatory structure, showing one of the pivotal connectors with the second dome segment attached and in its raised position.
Figure 8:
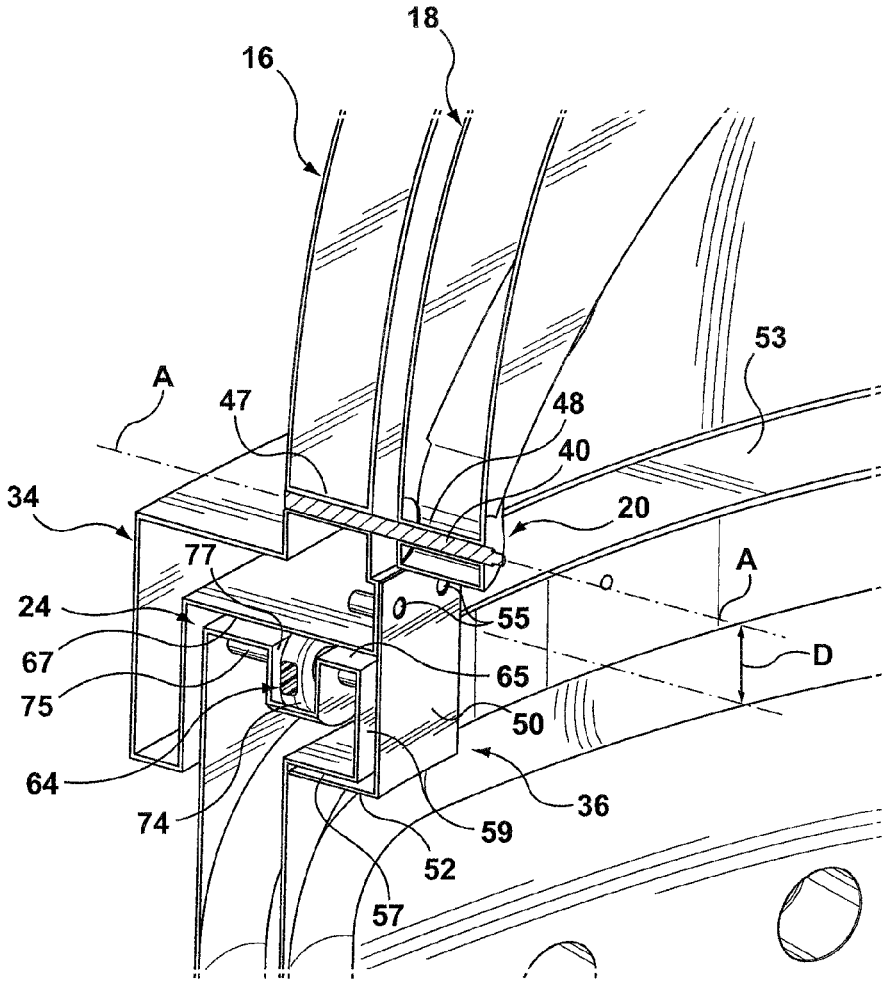
FIG. 8 is an isometric cross sectional view of a portion of the subject observatory structure, taken along line 8-8 in FIG. 7.

Referring now to FIGS. 6, 7 and 8, each of hinge portions 20*a*, 20*b* preferably comprises a hinge pin 40 extending from a lower portion of first dome segment 16 along horizontal pivot axis A. Hinge pin 40 is preferably a steel hinge pin that is fixedly mounted within hinge pin mount 47. As shown in FIGS. 6 and 7, hinge pin 40 is shaped to fit within and extend through hinge pin bore 48 in second dome segment 18. Hinge pin bore 48 is sized to be slightly larger than the diameter of hinge pin 40 so that second dome segment 18 can be freely rotated about hinge pin 40. Hinge pin 40 is mounted collinearly, along horizontal pivot axis A, with the other hinge pin (not shown) on the diametrically opposed side edge of hemispherical dome 14. Pivot axis A is offset a distance D above top 65 of top collar 24 to allow corner 58 of second dome segment 18 to clear top 65 when second dome segment 18 is pivoted about axis A.

Top collar portion 24 preferably comprises a plurality of inwardly protruding lip portions 44*a*, 44*b* of adjacent wall panels 21*a*, 21*b*, separated by gap 49. Retaining brackets 36 of first dome segment 16 are shaped to fit over lip portions 44*a* and 44*b*. Retaining brackets 36 are preferably angle brackets comprising a vertical bracket arm 50 and a horizontal bracket arm 52. Vertical bracket arm 50 is fixedly connected to the inside lower portion 53 of first dome segment 16 by connectors 55, and extend along inside face 59 of lip portions 44*a*, 44*b*. Horizontal bracket arm 52 extends below the bottom surface 57 of lip portions 44*a*, 44*b*, leaving some clearance to allow first dome segment 16 to be freely rotated about top collar portion 24. Because dome 14 is guided along top collar portion 24 of base 12 by skirt 34 and along inside face 59 of lip portions 44*a*, 44*b* by vertical bracket arm 50, dome 14 is constrained to follow the circumference of top collar portion 24. Dome 14 is prevented from detaching off base 12 by retaining brackets 36 because horizontal bracket arm 52 will contact bottom surface 57 of lip portions 44*a*, 44*b* when dome 14 is lifted up.

Top collar portion 24 comprises roller assemblies 64 extending upwardly from top surface 65 for engaging the bottom surfaces 67, 68 of dome segments 16, 18. Roller assemblies 64 lessen the force required to rotate hemispherical dome 14. As best shown in FIG. 8, each of roller assemblies 64 comprises a roller wheel 74 mounted on a roller axle 75 in a roller cavity 77 within the top surface 65 of top collar portion 24. Bottom surface 67 of first dome segment 16 sits in contact with and is supported by roller wheels 74.

Figure 9:
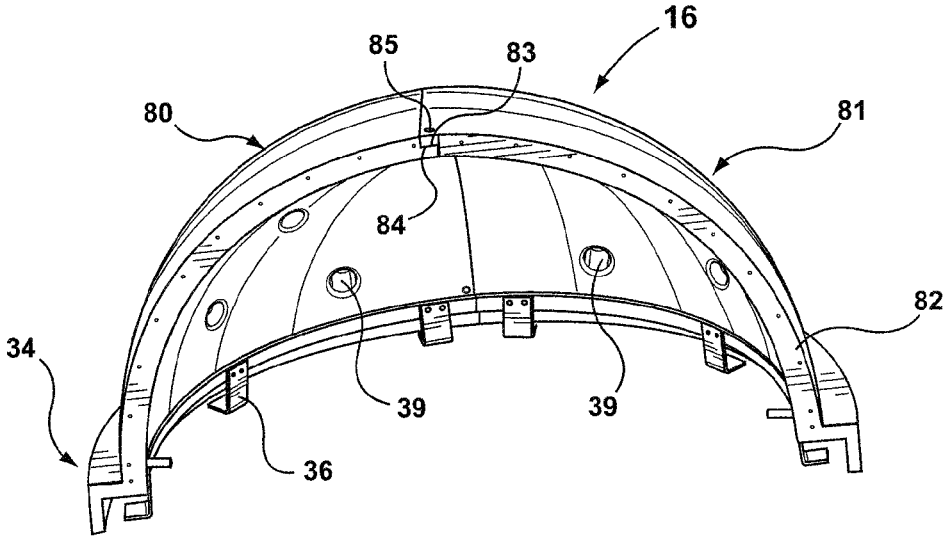
FIG. 9 is a perspective view of the first dome segment, shown unattached to the base.
Figure 10:
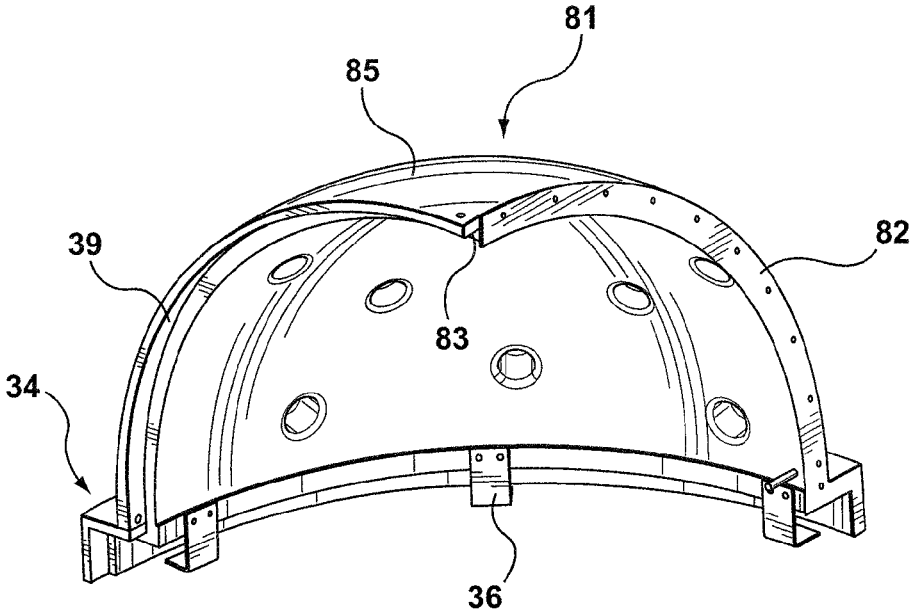
FIG. 10 is a perspective view of the right dome panel of the first dome segment.
Figure 11:
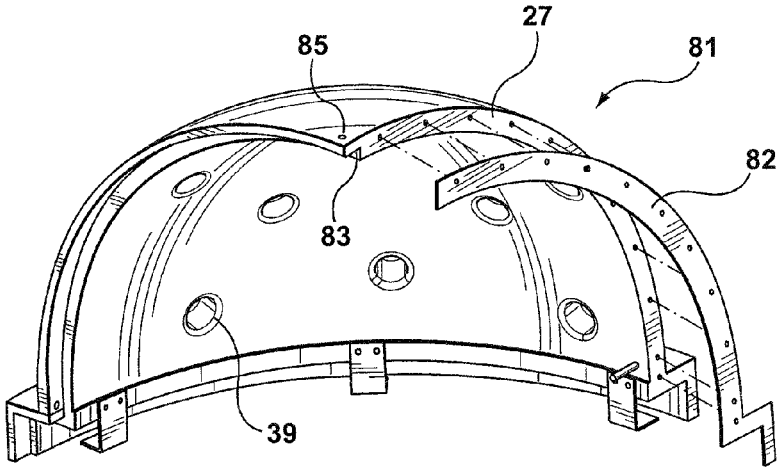
FIG. 11 is an exploded view of the right dome panel showing the manner in which the weather seal is attached.

Referring to FIGS. 9, 10 and 11, first dome segment 16 preferably comprises a left dome panel 80, and a right dome panel 81 having weather seal 82. Left dome panel 80 and right dome panel 81 interlock. Upper half-lap edge 83 of right dome panel 81 mates to lower half-lap edge 84 of left dome panel 80. Fasteners are fitted through fastening holes 85 to hold left dome panel 80 and right dome panel 81 together.

As shown in FIGS. 10 and 11, weather seal 82 is riveted to outside end face 27 of first dome segment 16 and is shaped to extend below end face 27 and to fill inter-dome gap 31 between first dome segment 16 and second dome segment 18. Weather seal 82 protects the interior of observatory structure 10 from the elements. Weather seal 82 is made of a weather stripping material, preferably a single strip of rubber similar to an automotive windshield wiper, but may comprise other types of flexible materials. It should be apparent that weather seal 82 could instead be attached to the outer surface 19 of second dome segment 18 near inside end face 28 at overlap area 29.

Figure 12:
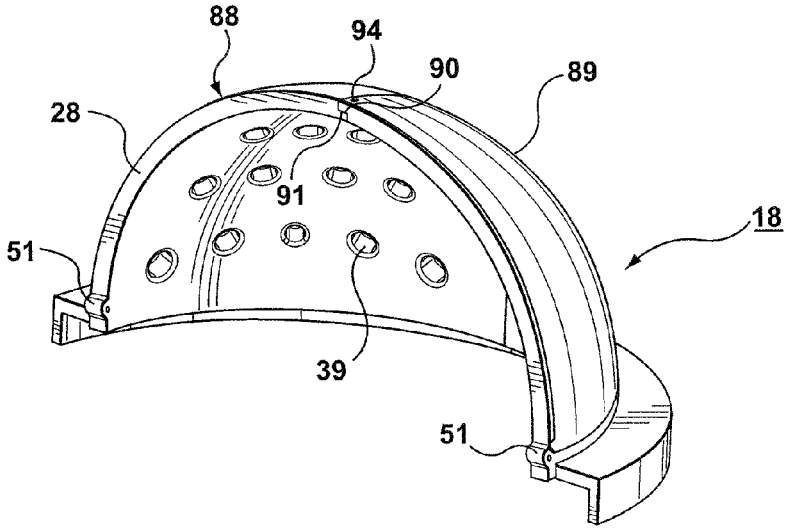
FIG. 12 is a perspective view of the second dome segment, shown unattached to the base.

Referring to FIG. 12, second dome segment 18 comprises a left dome panel 88, and a right dome panel 89. Left dome panel 88 and right dome panel 89 also interlock. As for first dome segment 16, upper half-lap edge 90 from right dome panel 89 mates to lower half-lap edge 91 from left dome panel 88. Fasteners are fitted through fastening apertures 94 to hold left dome panel 88 and right dome panel 89 together.

Inside end face 28 of second dome segment 18 is generally planar except for ear portions 51 that bulge outwardly from the plane, in order to hold hinge pin 40. Ear portions 51 are shaped to extend slightly beyond the plane of inside upright face 28 in order to provide enough surrounding material to position hinge pin bore 48 along pivot axis A.

Figure 13:
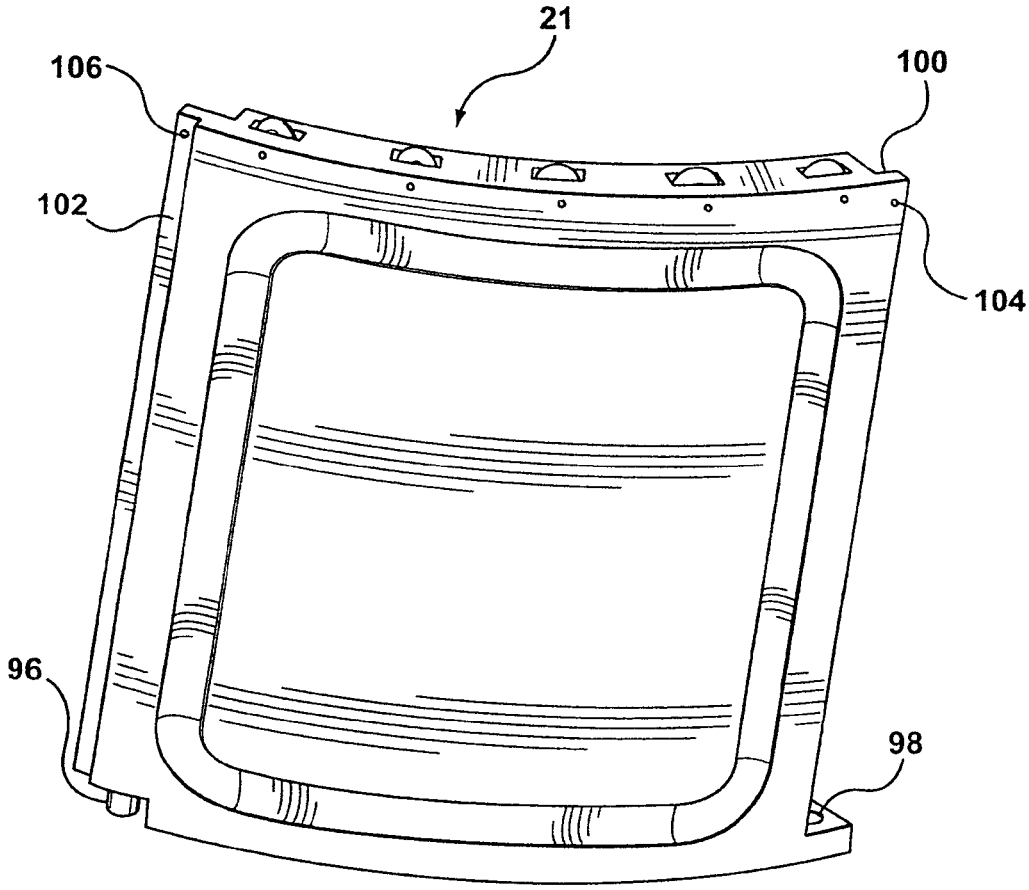
FIG. 13 is an isometric side view of one of the wall panels of the modular base.
Figure 14:
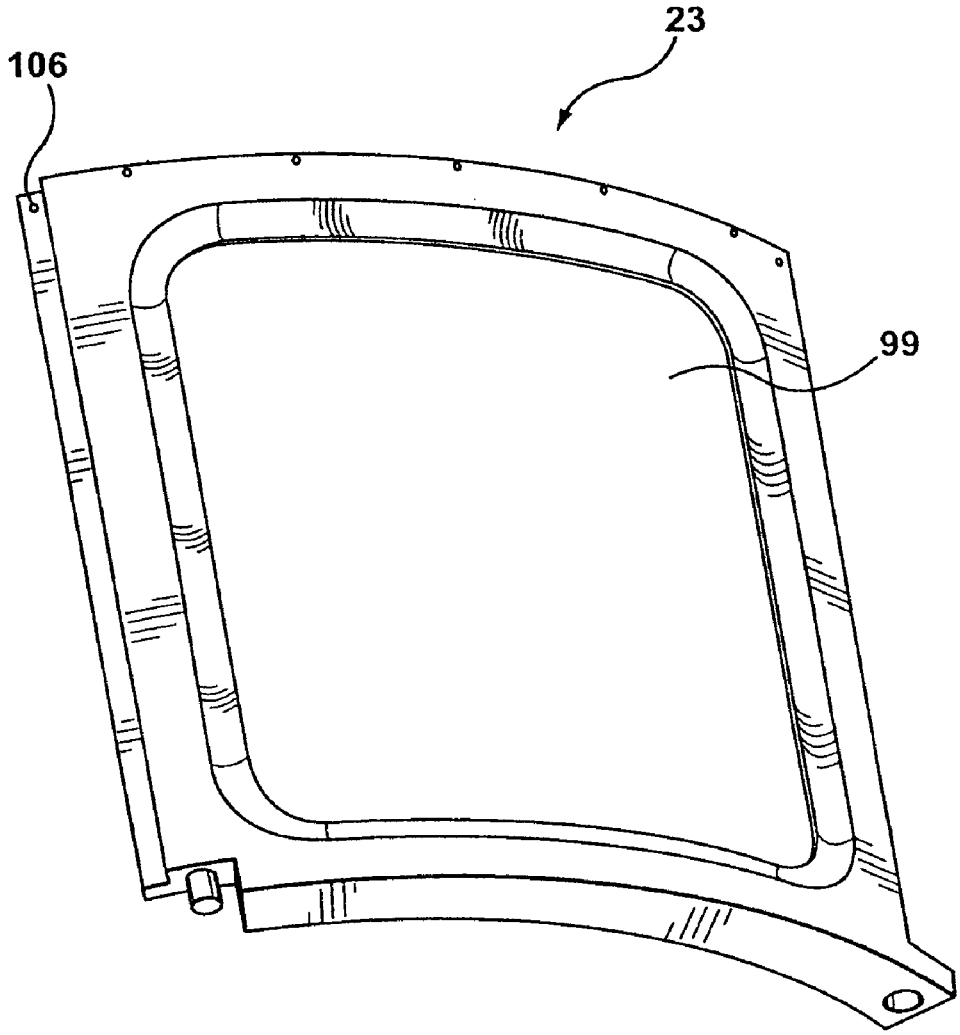
FIG. 14 is an isometric side view of the door panel of the modular base.
Figure 15:
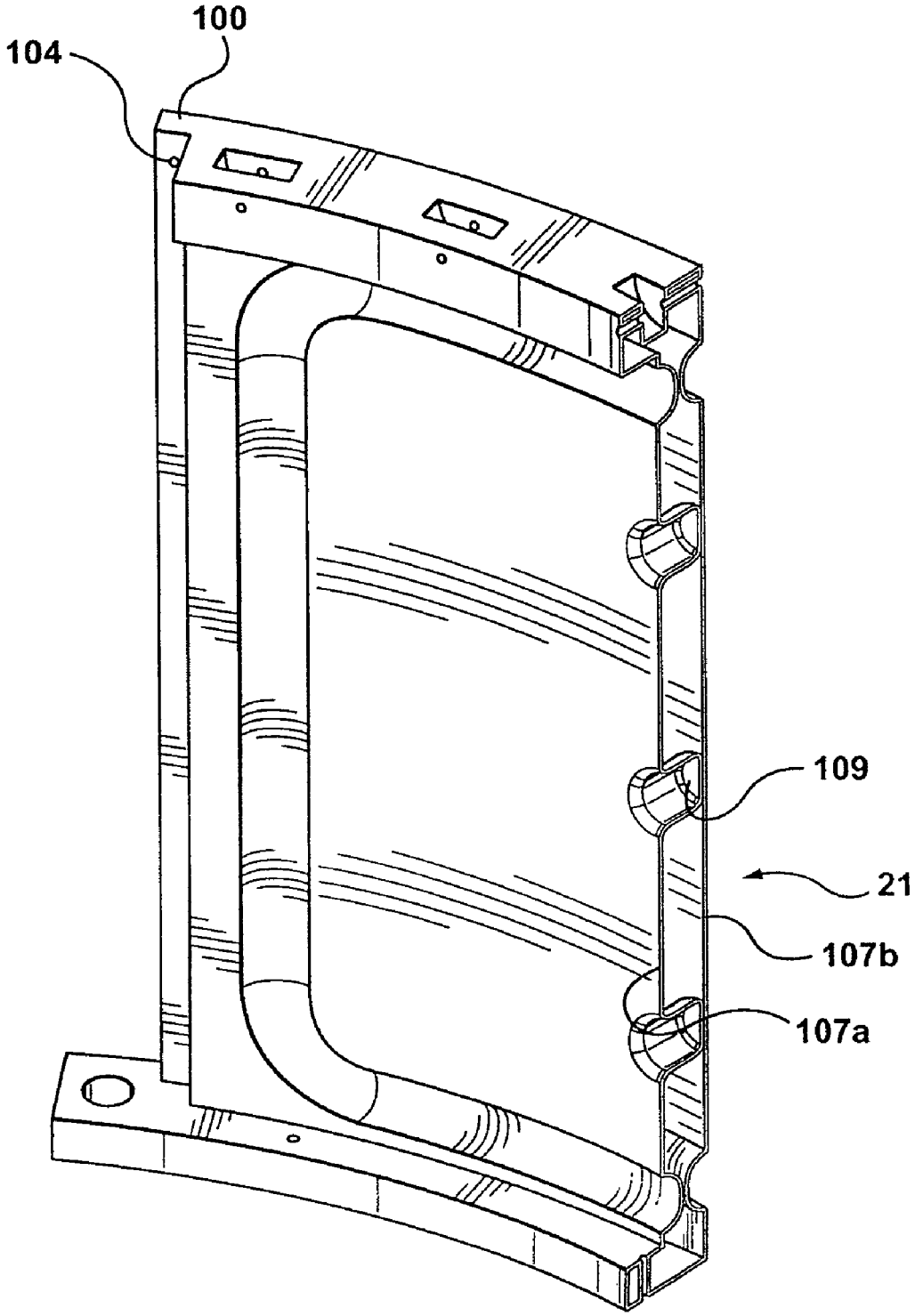
FIG. 15 is an isometric cross sectional view of one wall panel of the modular base.

Referring now to FIGS. 13,14 and 15, each wall panel 21 of base 12 is fitted to an adjacent wall panel by inserting interlock pin 96 into interlock aperture 98 on adjacent panel 21. Door panel 23 is formed similarly to wall panels 21 except for door opening 99 in the centre of the panel. In the preferred embodiment, door opening 99 is rectangular in shape, and is at least large enough to allow a user and a telescope or other observation instrument to pass through. In the preferred embodiment, there are five wall panels 21 and one door panel 23 interlocked together to form outside wall 22. In the preferred embodiment, each wall panel 21 is approximately 120 centimeters tall.

For each wall panel 21, the vertical edge of the wall panel on the side attached to interlock aperture 98 comprises an outer lap edge 100 with one or more wall fastening apertures 104 shaped to receive fasteners such as bolts. Outer lap edge 100 is shaped to fit inner lap edge 102 on the opposite side of wall panel 64. Inner lap edge 102 comprises one or more wall fastening apertures 106 through which door fastening bolts pass. The bolts are preferably threaded with wing nuts to hold adjacent panels 21 together.

A door (not shown) may be attached to enclose door opening 99 of door panel 23. In the preferred embodiment, the door is constructed of the plastic panels cut out from a wall panel 21 to create a door panel.

As shown in FIG. 15, wall panels 21 are preferably double wall panels made of hollow plastic having inner walls 107*a* and outer walls 107*b*, with inner walls having reinforcing indentations or kiss-offs 109, like those of dome segments 16, 18.

Figure 16:
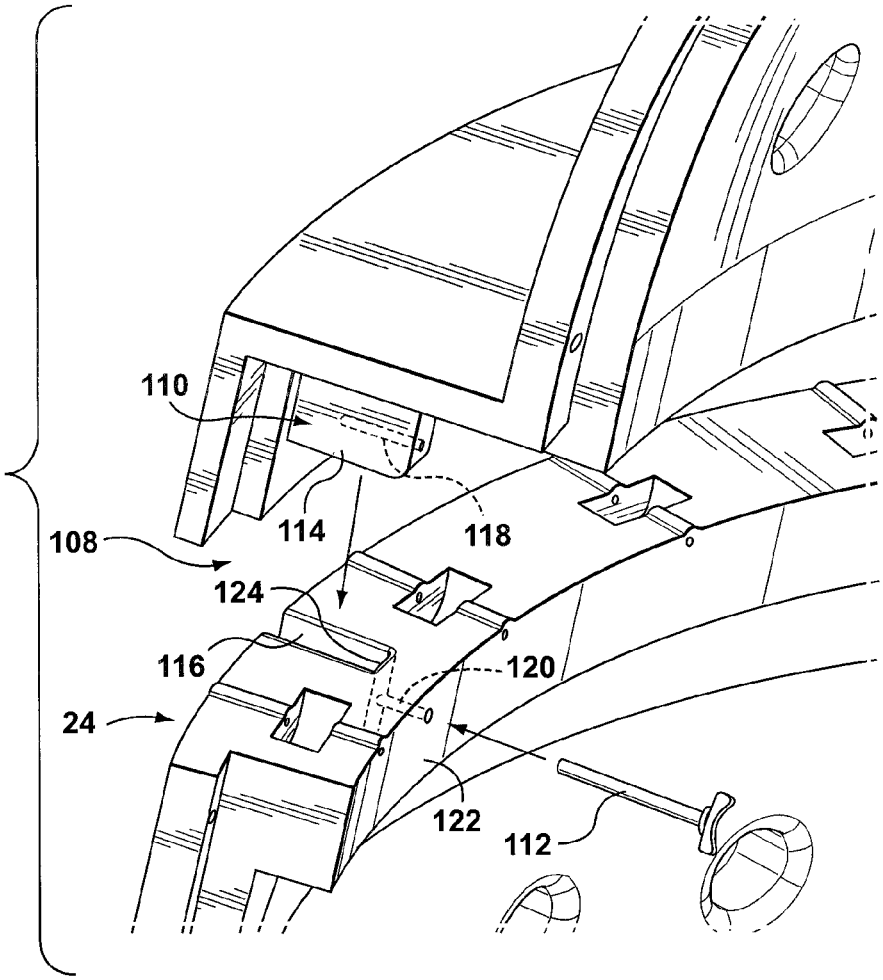
FIG. 16 is a detailed perspective view of a portion of the second dome segment and the top collar portion from inside the structure, showing the locking mechanism in an unengaged position.
Figure 17:
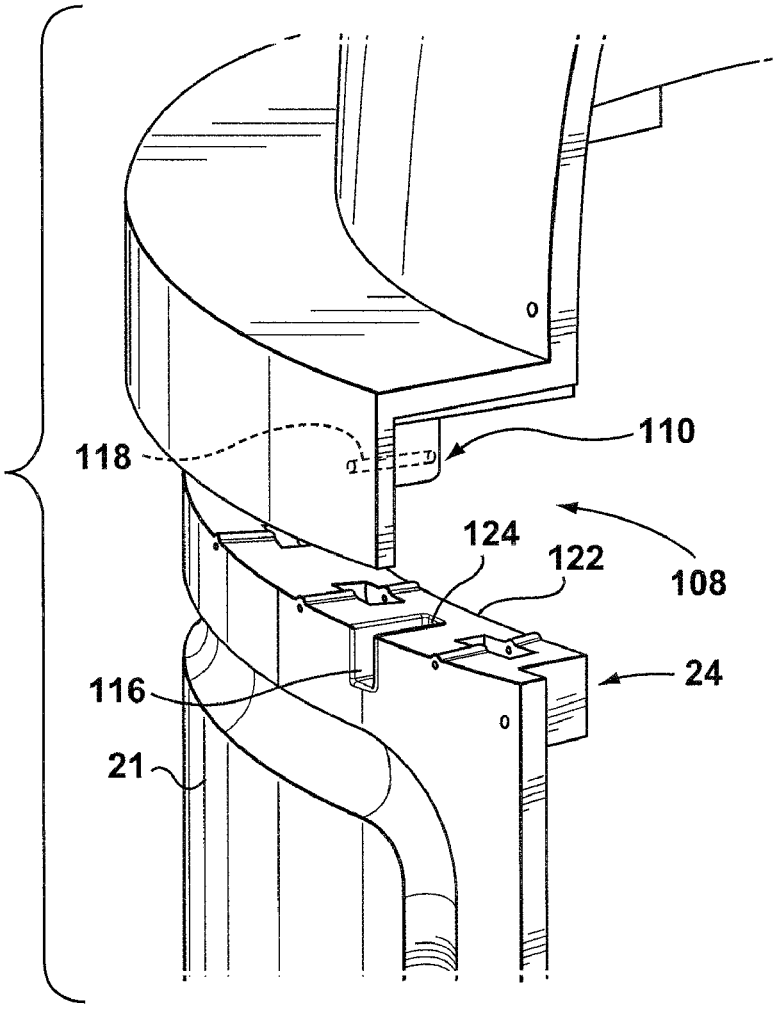
FIG. 17 is a detailed perspective view of a portion of the second dome segment and the top collar portion from outside the structure.
Figure 18:
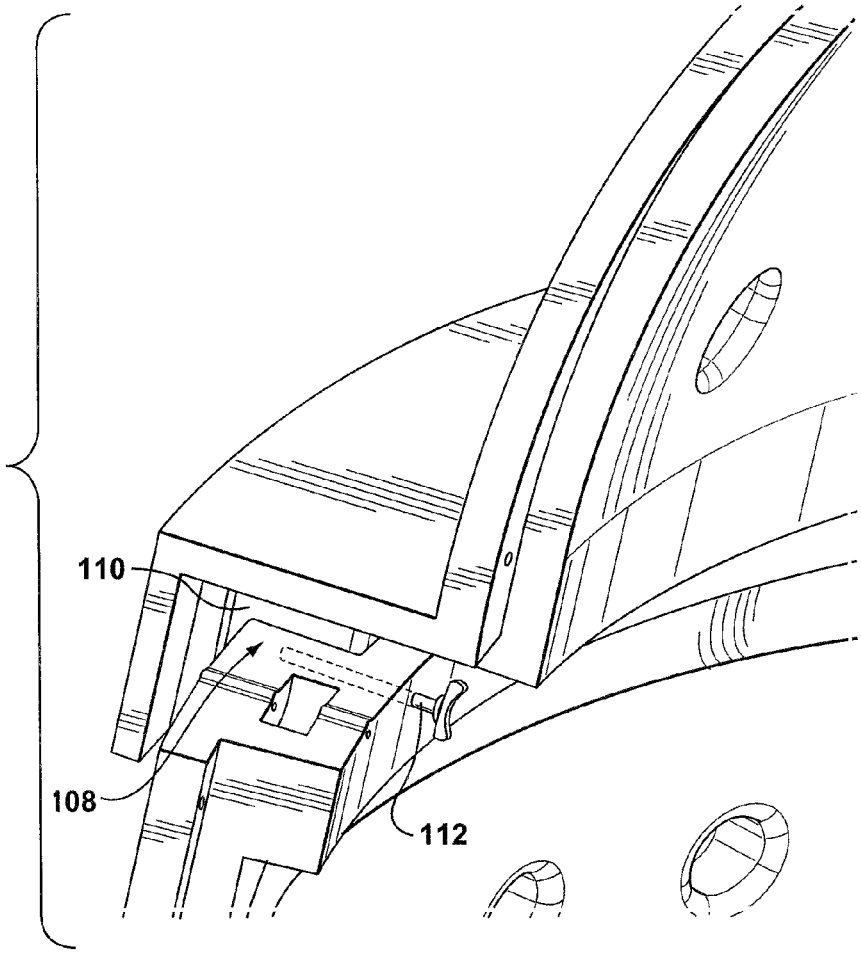
FIG. 18 is a detailed perspective view of a portion of the second dome segment and the top collar portion from inside the structure, showing the locking mechanism in an engaged position.

Referring now to FIGS. 16, 17 and 18, observatory structure 10 preferably includes locking mechanism shown generally as 108, comprising locking tongue 110, locking pin 112, and locking notch 116 located in top collar portion 24 of one of wall panels 21. Locking tongue 110 is shaped to be slightly less wide and less long than locking notch 116 so as to fit within notch 116. Lower portion 114 of tongue 110 has a first pin aperture 118 running longitudinally therethrough. Top collar portion 24 has a second pin aperture 120 that extends from inside upright wall 122 to inner edge 124 of notch 116.

When second dome segment 18 is in the fully closed position, locking tongue 110 fits in notch 116 where contact between locking tongue 110 and the inner walls of notch 116 prevents hemispherical dome 14 from rotating about top collar portion 24. First pin aperture 118 is aligned with second pin aperture 120 allowing locking pin 112 to be inserted therethrough, thereby preventing second dome segment 18 from being raised, or pivoted upward.

In use, personal observatory structure 10 is transported to the desired viewing location and assembled on site. Structure 10 can serve both as a temporary structure or as a permanent one depending on the wishes of the user. When observatory structure 10 is not in use, second dome segment 18 is lowered into the fully lowered position to protect the interior of structure 10 and its contents from the elements.

In order to make observations, second dome segment 18 is raised by a user until second protective skirt 35 abuts outside end face 27 of first dome segment 16, indicating that second dome segment 18 is in its fully opened or raised position. A handle may be affixed to the inner surface of second dome segment 18 to facilitate raising and lowering second dome segment 18.

If ambient light interferes with observation, the object of observation has crossed outside of view, or a different sector of the sky becomes of interest, dome 14 can be rotated around top collar portion 24 to accommodate different views or to provide a light shade from certain angles.

When finished, second dome segment 18 can be lowered by user and may be locked into place using locking mechanism 108.

It should be apparent to one skilled in the art that the present invention has a number of advantages over prior art observatories. Being made of light weight plastic, modular and smaller in size, this personal observatory is inexpensive to manufacture, to ship and to transport and is easy to assemble. By providing a large opening instead of a restricted, rectangular shutter, turbulence due to the chimney effect is minimized, as a large volume of air is able to escape when the dome is opened and temperatures inside and outside of the observatory structure are quickly equalized. Further, because the dome rotates, any portion of the sky can be observed, as there is no fixed roof section permanently obscuring one angle. Also because of the large opening compared to existing rectangular shutters, less rotation of the dome is necessary in order to expose different portions of the sky; if automated telescopes are used to track an object over the course of a night, the one hundred eighty degree field of view provided by this personal observatory structure should be sufficient, meaning no motors and synchronization mechanism need be installed to keep dome rotation and telescope position synchronized.

While the preferred embodiment comprises a dome structure in which the inside dome segment is pivotally connected to the outside dome segment so as to pivot into and nest within the first dome segment, it should be understood that the structure could be modified so that the outside dome is pivotally connected to the inside dome so as to pivot over and cover the inside dome segment.

It should also be apparent to one skilled in the art that the roller assembly could be mounted on the bottom of the hemispherical dome instead of on the top of the base. For example, roller assembly could be mounted on the bottom face of the first dome segment and he second dome segment instead of on cylindrical top collar portion. It should further be apparent that other types friction reducing devices may be substituted for roller assembly. These devices may include, but are not limited to, ball bearings in a track, slippery coatings such as Teflon or a lubricant, twin wheels mounted horizontally instead of vertically in order to sandwich the bottom of the hemispherical dome between them, and so on.

While the preferred embodiment comprises a base having cylindrical outside wall, it should be understand that the base could take a form other than cylindrical. For example, the base may be cubic or rectangular, so long as the base includes top collar portion shaped to mate with bottom of the dome segments.

In some embodiments, depending on the material used for construction, it may be desirable to insert gaskets between the joints of the wall panels and the dome panels. It may also be desirable to provide a cushioning material between the retaining brackets and the inwardly projecting upper lips of the wall. This would reduce or damp rattling and noise.

It should therefore be apparent to one skilled in the art that various modifications can be made to the embodiments disclosed herein, without departure from the invention, the scope of which is defined in the appended claims.

The invention claimed is:

1. A personal observatory structure, comprising:

a) a base having an open top; and b) a hemispherical dome having a center point, the dome being shaped to be mounted upon the base and to selectively enclose the open top;

c) wherein the dome comprises a first dome segment having a spherical inner surface extending at a first radius from the center point, and a second dome segment having an outer surface extending at a second radius from the center point, the second radius being smaller than the first radius; and d) wherein the first dome segment and the second dome segment are connected together by pivotal connectors for movement about a pivot axis so that one of the dome segments can be pivoted about the pivot axis between a lowered position in which the dome segments together enclose the open top, and a raised position in which one of the dome segments nests within the other;

e) wherein the base comprises an upwardly extending cylindrical top collar portion, and the dome is mounted on the top collar portion;

f) wherein the base comprises a cylindrical outside wall, and wherein the top collar portion extends upwardly from the outside wall; and g) wherein the base is a modular base, and the cylindrical outside wall comprises a plurality of curved interlocking wall panels, wherein each of the wall panels interconnects with an adjacent one of the wall panels to form the outside wall.

2. The structure of claim 1, wherein the pivot axis is a horizontal pivot axis that extends through the center point.

3. The structure of claim 2, wherein the first dome segment and the second dome segment are shaped generally in the form of a quarter sphere.

4. The structure of claim 3, wherein the first dome segment has an outside end face, and the second dome segment has an inside end face, and wherein the first dome segment is shaped so as to include an overlap portion such that the outside end face of the first dome segment extends over the inside end face of the second dome segment when the dome segments are in the lowered position.

5. The structure of claim 4, wherein the second dome segment is pivotally connected to the first dome segment so that the second dome segment can be pivoted about the pivot axis and nest within the first dome segment.

6. The structure defined in claim 5, wherein the second dome segment can be pivoted about the pivot axis by a pivot angle of approximately 90 degrees.

7. The structure of claim 2, wherein the pivotal connectors comprise a pair of hinge portions on diametrically opposing side edges of the dome segments, each of the hinge portions comprising a hinge pin extending along the pivot axis.

8. The structure of claim 7, wherein each of the hinge pins extends inwardly from a lower portion of the first dome segment, and is dimensioned to be rotatably mounted in a hinge pin bore in the second dome segment.

9. A personal observatory structure, comprising:

a) a base having an open top; and b) a hemispherical dome having a center point, the dome being shaped to be mounted upon the base and to selectively enclose the open top;

c) wherein the dome comprises a first dome segment having a spherical inner surface extending at a first radius from the center point, and a second dome segment having an outer surface extending at a second radius from the center point, the second radius being smaller than the first radius;

d) wherein the first dome segment and the second dome segment are connected together by pivotal connectors for movement about a pivot axis so that one of the dome segments can be pivoted about the pivot axis between a lowered position in which the dome segments together enclose the open top, and a raised position in which one of the dome segments nests within the other; and e) weather sealing means for providing a flexible weather resistant seal between the outer surface of the second dome segment and the inner surface of the first dome segment.

10. The structure defined in claim 9, wherein the weather sealing means comprises an arcuately shaped strip of flexible material extending downwardly from an end face of the first dome segment to so as to fill an inter-dome gap between the inner surface of the first dome segment and the outer surface of the second dome segment.

11. A personal observatory structure, comprising:

a) a base having an open top; and b) a hemispherical dome having a center point, the dome being shaped to be mounted upon the base and to selectively enclose the open top;

c) wherein the dome comprises a first dome segment having a spherical inner surface extending at a first radius from the center point, and a second dome segment having an outer surface extending at a second radius from the center point, the second radius being smaller than the first radius;

d) wherein the first dome segment and the second dome segment are connected together by pivotal connectors for movement about a pivot axis so that one of the dome segments can be pivoted about the pivot axis between a lowered position in which the dome segments together enclose the open top, and a raised position in which one of the dome segments nests within the other;

e) wherein the base comprises an upwardly extending cylindrical top collar portion, and the dome is mounted on the top collar portion;

f) wherein the dome is rotatably mounted on the top collar portion for rotation around the top collar portion about a vertical axis of rotation; and g) wherein the top collar portion comprises a plurality of roller assemblies extending upwardly from a top surface thereof for engaging bottom surfaces of the dome segments.

12. The structure of claim 11, wherein each of the roller assemblies comprises a roller wheel mounted on a roller axle in a roller cavity located below the top surface of the top collar portion, the roller axle being mounted for rotation about a roller axis extending radially from the vertical axis of rotation.

13. A personal observatory structure, comprising:

a) a base having an open top; and b) a hemispherical dome having a center point, the dome being shaped to be mounted upon the base and to selectively enclose the open top;

c) wherein the dome comprises a first dome segment having a spherical inner surface extending at a first radius from the center point, and a second dome segment having an outer surface extending at a second radius from the center point, the second radius being smaller than the first radius;

d) wherein the first dome segment and the second dome segment are, connected together by pivotal connectors for movement about a pivot axis so that one of the dome segments can be pivoted about the pivot axis between a lowered position in which the dome segments together enclose the open top, and a raised position in which one of the dome segments nests within the other;

e) wherein the base comprises an upwardly extending cylindrical to collar portion, and the dome is mounted on the top collar portion: and f) wherein the first dome segment comprises a first protective skirt extending outwardly from a peripheral portion thereof, the first protective skirt being shaped to extend over the top collar portion.

14. The structure of claim 13, wherein the second dome segment comprises a second protective skirt extending outwardly from a peripheral portion thereof, the second protective skirt shaped to extend over the top collar portion, the second protective skirt serving as a stopper to prevent the second dome segment from pivoting farther than a pivot angle of approximately 90 degrees.

15. The structure of claim 14, wherein the first protective skirt comprises a horizontal ledge portion and a vertical portion extending below the top surface of the top collar portion, and the second protective skirt comprises a horizontal ledge portion and a vertical portion extending below the top surface of the top collar portion when the second dome segment is the lowered position.

16. A personal observatory structure, comprising:

a) a base having an open top; and b) a hemispherical dome having a center point, the dome being shaped to be mounted upon the base and to selectively enclose the open top;

c) wherein the dome comprises a first dome segment having a spherical inner surface extending at a first radius from the center point, and a second dome segment having an outer surface extending at a second radius from the center point, the second radius being smaller than the first radius;

d) wherein the first dome segment and the second dome segment are connected together by pivotal connectors for movement about a pivot axis so that one of the dome segments can be pivoted about the pivot axis between a lowered position in which the dome segments together enclose the open top, and a raised position in which one of the dome segments nests within the other;

e) wherein the base comprises an upwardly extending cylindrical top collar portion, and the dome is mounted on the top collar portion;

f) wherein the dome is rotatably mounted on the top collar portion for rotation around the top collar portion about a vertical axis of rotation; and g) a dome retention mechanism for retaining the dome segments to the base, wherein the dome retention mechanism comprises a plurality of retaining brackets attachable to the first dome segment, the brackets being shaped to slidably engage the top collar portion.

17. The structure of claim 16, wherein each of the retaining brackets comprises an angle bracket having a vertical arm and a horizontal arm, the vertical arm being connectable to a lower circumferentially extending portion of the first dome segment, the horizontal arm being shaped to fit under an inwardly projecting lip of the top collar portion.

18. A personal observatory structure, comprising:

a) a base having an open top; and b) a hemispherical dome having a center point, the dome being shaped to be mounted upon the base and to selectively enclose the open top;

c) wherein the dome comprises a first dome segment having a spherical inner surface extending at a first radius from the center point, and a second dome segment having an outer surface extending at a second radius from the center point, the second radius being smaller than the first radius;

d) wherein the first dome segment and the second dome segment are connected together by pivotal connectors for movement about a pivot axis so that one of the dome segments can be pivoted about the pivot axis between a lowered position in which the dome segments together enclose the open top, and a raised position in which one of the dome segments nests within the other; and e) a dome locking mechanism for selectively preventing opening of the second dome segment.

19. The structure of claim 18, wherein the base comprises an upwardly extending cylindrical top collar portion, and the dome is mounted on the top collar portion, and wherein the dome locking mechanism comprises a tongue extending downwardly from an inside portion of the second dome segment, the tongue being shaped to fit into a notch in the top collar portion, the tongue having a first pin aperture therein and the top collar portion having a second pin aperture therein, the second pin aperture being aligned with the first pin aperture when the tongue is inserted into the notch, and a locking pin shaped to extend through the second pin aperture and fit into the first pin aperture.

* * * * *